United States Patent [19]

Folkins

[11] Patent Number: 4,611,900

[45] Date of Patent: Sep. 16, 1986

[54] APPARATUS FOR SENSING THE PRESENCE OF TONER PARTICLES

[75] Inventor: Jeffrey J. Folkins, Rochester, N.Y.

[73] Assignee: Xerox Corporation, Stamford, Conn.

[21] Appl. No.: 616,033

[22] Filed: Jun. 1, 1984

[51] Int. Cl.[4] ..... G03G 15/09

[52] U.S. Cl. ..... 355/3 DD; 118/688; 118/689

[58] Field of Search ..... 355/3 R, 3 DD, 14 D; 118/656, 688, 689, 690

[56] References Cited

U.S. PATENT DOCUMENTS

| | | | |
|---|---|---|---|
| 3,892,672 | 7/1975 | Gawron | 355/3 DD X |
| 3,932,034 | 1/1976 | Takahashi | 355/3 DD |
| 4,181,422 | 1/1980 | Forgo et al. | 355/3 DD |
| 4,343,548 | 8/1982 | Bares et al. | 355/3 DD |
| 4,524,088 | 6/1985 | Fagen et al. | 355/14 D X |

*Primary Examiner*—Fred L. Braun

*Attorney, Agent, or Firm*—H. Fleischer; J. E. Beck; R. Zibelli

[57] ABSTRACT

An apparatus in which the presence of toner particles is detected. The apparatus includes a member adapted to be charged by the toner particles in contact therewith. A signal is transmitted in response to the member being charged to indicate the presence of toner particles in contact with the member.

6 Claims, 3 Drawing Figures

APPARATUS FOR SENSING THE PRESENCE OF TONER PARTICLES

This invention relates generally to a development system used in an electrophotographic printing machine, and more particularly concerns an apparatus which detects the presence of toner particles in the development system.

Generally, in the process of electrophotographic printing, a photoconductive member is charged to a substantially uniform potential to sensitize the surface thereof. The charged portion of the photoconductive surface is exposed to a light image of an original document being reproduced. This records a electrostatic latent image on the photoconductive member corresponding to the informational areas contained within the original document. After recording the electrostatic latent image on the photoconductive member, the latent image is developed by bringing a developer material into contact therewith. In a single component development system, the developer material includes magnetic toner particles. The toner particles are attracted to the latent image to form a toner powder image on the photoconductive member which is subsequently transferred to a copy sheet. Thereafter, the toner powder image is permanently affixed to the copy sheet in image configuration.

The various station for charging, exposing, developing, transferring, cleaning and discharging are usually separate units disposed about the photoconductive member. The complexity and associate cost of the printing machine may be significantly reduced if these separate units are combined to perform dual functions. In a printing machine of this type, it is very important to insure that the latent image formed on the photoconductive member is perfectly developed with any residual particles remaining thereon being subsequently cleaned therefrom. Thus, the efficiency of the development/cleaning device is highly significant. Hereinbefore, a magnetic brush system has been employed for both development and cleaning. It has been found that both development and cleaning are significantly improved by forming a wedge-shaped thickening of a layer of toner particles adhering to the magnetic brush in the region between the magnetic brush and the photoconductive member. In order to maintain this wedge-shape thickening of toner particles at a preselected level, it is necessary to sense the level and control the dispensing of toner particles to the magnetic brush so as to maintain the level at the desired thickness. Various techniques have been devised to control the thickness of the level of the wedge-shaped toner particles. The following disclosure appears to be relevant:

U.S. Pat. No. 4,181,422, Patentee: Forgo et al., Issued: Jan. 1, 1980.

The pertinent portions of the foregoing disclosure may be briefly summarized as follows:

Forgo et al. describes an electrophotographic printing machine employing a combined developing-cleaning unit. The combined developing-cleaning unit is a magnetic brush unit wherein a wedge-shaped thickening layer of toner particles is formed between the magnetic brush and the photoconductive drum in the region of contact therebetween. A mechanically operating sensing member, an induction coil or a capacitive sensor may be used for monitoring the size of the thickening of the layer of toner particles in the region of contact.

In accordance with one aspect of the features of the present invention, there is provided an apparatus for detecting the presense of toner particles. The apparatus includes a member adapted to be charged by toner particles in contact therewith. Means, in communication with the member, transmit a signal in response to the member being charged to indicate the presence of toner particles in contact with the member.

Pursuant to another aspect of the present invention, there is provided an apparatus for developing a latent image recorded on an image bearing member with toner particles. Means are provided for transporting toner particles closely adjacent to the latent image. Means supply toner particles to the transporting means. Means sense the thickness of layer of toner particles formed on the transporting means. The sensing means is charged by toner particles in contact therewith and transmits a signal in response thereto for controlling the dispensing of particles to the transporting means by the supplying means.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
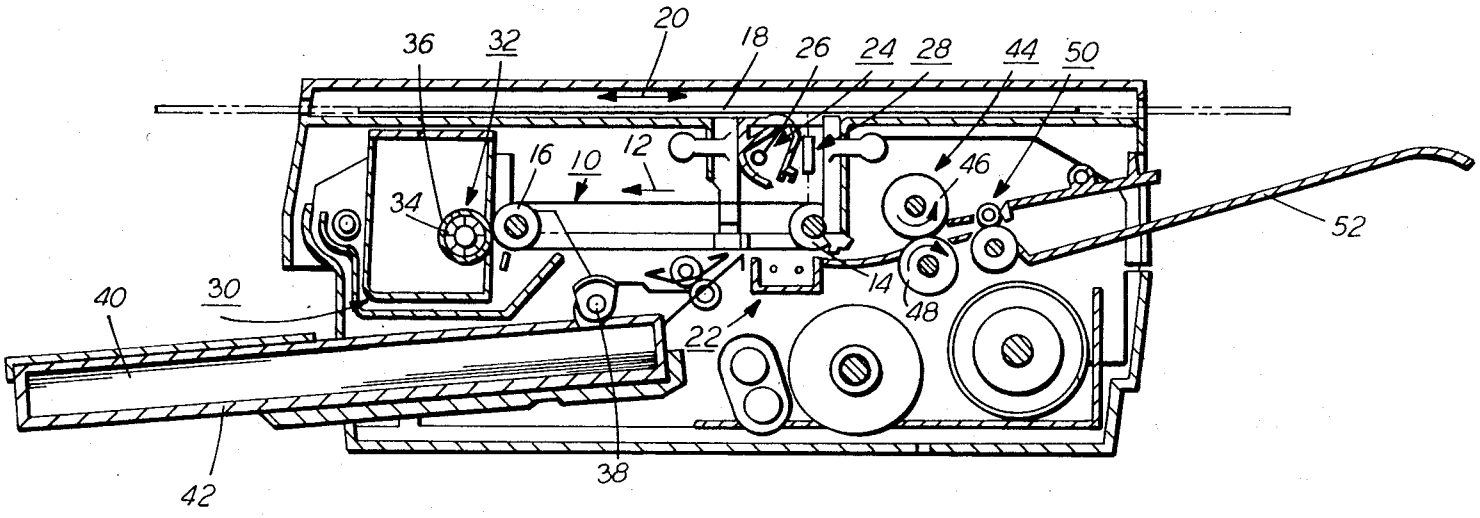
FIG. 1 is a schematic, elevational view depicting an exemplary electrophotographic printing machine incorporating the features of the present invention therein.

For a general understanding of the features of the present inventions, reference is made to the drawings. In the drawings, like reference numerals have been used throughout to designate identical elements. FIG. 1 schematically depicts the various components of an illustrative electrophotographic printing machine incorporating the feature of the present invention therein. It will become evident from the following discussion that these features are equally well suited for use in a wide variety of electrophotographic printing machines, and are not necessarily limited in their application to the particular embodiment depicted herein.

Referring now to FIG. 1, the electrophotographic printing machine employs a belt 10 having a photoconductive surface deposited on a conductive substrate. Preferably, the photoconductive surface is made from a organic photoconductor with the conductive substrate being made from an aluminum alloy. Belt 10 moves in the direction of arrow 12 to advance successive portions of the photoconductive surface through the various processing stations disposed about the path of movement thereof. Rollers 14 and 16 maintain belt 10 under suitable tension. Roller 14 is coupled to a drive system. As roller 14 rotates, it advances belt 10 in the direction of arrow 12. An original document is disposed face down upon a transparent platen 18. Platen 18 is mounted in a frame which is capable of reciprocating motion in a horizontal direction, as indicated by arrow 20. Belt 10 is driven at a linear velocity substantially equal to the linear velocity of platen 18. Belt 10 moves in a recirculating path. In order to reproduce a copy of an original document, belt 10 performs two complete cycles of movement through the recirculating path.

During the first cycle, belt 10 advances a portion of the photoconductive surface beneath a charging-transferring unit, indicated generally by the reference numeral 22. Charging-transferring unit 22 includes a corona generating device which charges the photoconductive surface of belt 10 to a relatively high substantially uniform potential.

Next, belt 10 advances the charged portion of the photoconductive surface beneath a combined exposing-discharging unit, indicated generally by the reference numeral 24. Combined exposing-discharging unit 24 includes a light source 26, preferably an elongated tungston lamp. Light source 26 is disposed stationarily beneath platen 18. An opaque shield surrounds light source 26. The shield has a slit therein so that the light rays from light source 26 are projected onto the original document exposed face down on transparent platen 18. As platen 18 moves in the direction of arrow 20, successive incremental portions of the original document are illuminated. Light rays reflected from the original document are transmitted through a bundle of image transmitting fibers, indicated generally by the reference numeral 28. The image transmitting fibers 28 are bundled radiated index optical fibers. U.S. Pat. No. 3,658,407 issued to Kitano et al. in 1972 describes a light conducting fiber made of glass or synthetic resin which has a refractive index distribution in cross section thereof that varies consecutively and parabolically outwardly from a center portion thereof. Each fiber acts as a focusing lens to transmit part of an image placed, or near one end thereof. An assembly of fibers, in a staggered two row array, transmit and focus a complete image of the object. The fiber lens are produced under the tradename "Selfoc", the mark is registered in Japan and owned by Nippon Sheet Glass Company, Limited. These index lens arrays are used as a replacement for conventional optical systems in electrophotographic printing machines, such as being disclosed in U.S. Pat. No. 3,947,106, Issued to Hanaguchi et al. in 1976, and U.S. Pat. No. 3,977,777, issued to Tanka et al. in 1976. The relevant portions of the foregoing patents are hereby incorporated into the present disclosure. The light ray reflected from the original document are transmitted through the image transmitting fibers onto the charged portions of the photoconductive surface of belt 10 to selectively dissipate the charge thereon. This records an electrostatic latent image on the photoconductive surface of belt 10 which corresponds to the informational areas contained within the original document.

Thereafter, belt 10 advances the electrostatic latent image recorded on the photoconductive surface to a combined developing-cleaning unit, indicated generally by the reference numeral 30. Combined developing-cleaning unit 30 includes a magnetic brush roller indicated generally by the reference numeral 32. Magnetic brush roller 32 comprises of an elongated, cylindrical magnet 34 mounted interiorily of tublar member 36. Tubular member 36 rotates to transport single component magnetic toner particles into contact with the photoconductive surface of belt 10. The toner particles are attracted to the electrostatic latent image to form a toner powder image thereon.

After the toner powder image is formed on the photoconductive surface of belt 10, belt 10 returns the powder image to the combined charging-transferring unit 22 to the start the second cycle. At this time, a copy sheet is advanced by sheet feeder 38 from a stack 40 supported in tray 42 to combined charging-transferring unit 22. The copy sheet is advanced in a timed sequence so as to be in synchronism with the toner powder image formed on the photoconductive surface of belt 10. In this way, one side of the copy sheet contacts the toner powder image at combined charging-tranferring unit 22. Combined charging-transferring unit 22 sprays ions onto the backside of the copy sheet. This attracts the toner powder image from the photoconductive surface of belt 10 to the sheet. After transfer, the sheet continues to move with belt 10 until the beam strength thereof causes it to strip therefrom as belt 10 passes around roller 14.

As the sheet separates from belt 10, it advances to a fuser assembly, indicated generally by the reference numeral 44. Preferably, fuser assembly 44 includes rollers 46 and 48. These rollers apply pressure to permanently affix the toner powder image to the copy sheet. Thereafter, exiting rollers indicated generally by the reference numeral 50 advance the sheet into catch tray 52 for subsequent removal from the printing machine by the operator.

Thereafter, belt 10 continues to advance the residual toner particles adhering to the photoconductive surface to combined exposing-discharging unit 24. Here, the photoconductive surface is substantially, uniformly illuminated to weaken the attractive force between the residual toner particles and the photoconductive surface. Belt 10 continues to move in the direction of arrow 12 to advance these residual toner particles to combined developing-cleaning unit 30. At this station, the residual toner particles adhering to the photoconductive surface of belt 10 are removed thereform. The detailed structure of combined developing-cleaning unit 30 will be discussed hereinafter with reference to FIGS. 2 and 3.

Figure 2:
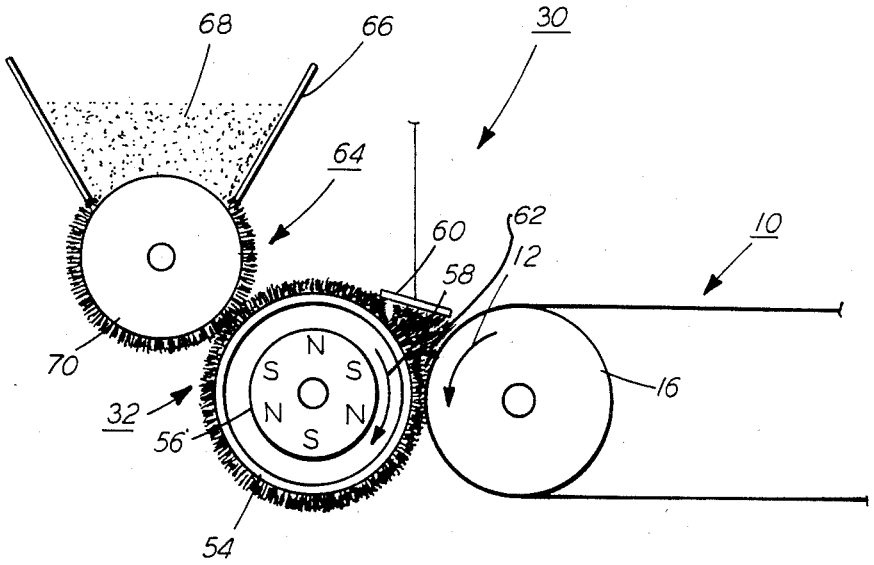
FIG. 2 is a schematic, elevational view showing the development system used in the FIG. 1 printing machine.

Turning now to FIG. 2, there is shown a development system and the apparatus for detecting the presence of toner particles in the wedge at a preselected thickness. Development-cleaning unit 30 includes a magnetic brush developer roller 32. Magnetic brush developer roller 32 includes a tubular member 54 rotating about magnet 56 in the direction of arrow 58. A plate 60 is positioned in the region between magnetic brush 32 and belt 10 at a preselected position corresponding to the desired thickness of the wedge-shaped layer of toner particles 62 in the region of contact of the layer of toner particles on magnetic brush 32 with belt 10. Plate 60 is adapted to be charged by the toner particles in contact therewith. The toner particles may have a space charge, some of which is transmitted to plate 60 when the toner particles are in contact therewith. The space charge on the toner particles may be caused by any of the following: the triboelectric charging of the toner particles contacting the photoconductive surface of belt 10, induction charge induced in the toner particles due to the potential of the photoductive surface of belt 10 and development of charged toner particles onto the photoconductive surface of belt 10. In addition to transmitting some of the space charge of the toner particles to plate 60, plate 60 may be also charged triboelectrically by the toner particles agitating thereagainst. Thus, plate 60 is positioned above magnetic brush roller 32 at the height at which it is desired to detect the level of toner particles. When the toner particles reach the level of plate 60, the toner particles charge plate 60 to produce an electrical current. The electrical current output from plate 60 may be employed as an on/off or threshold device to detect the presence or absence of toner particles at the desired level. The current produced by the charging of plate 60 is transmitted to a control circuit which, in turn, de-energizes the dispensing of toner particles from toner dispenser 64. Toner dispenser 64 includes a hopper 66 storing a supply of toner particles 68 therein. A foam roller 70 is positioned in the open end of hopper 66. Foam roller 70 is coupled to a drive motor. The toner dispenser drive motor is de-energized when plate 60 generates an electrical output signal. At all other times, the toner dispenser drive motor is energized to rotate the foam roller 70 discharging toner particles 68 from hopper 66. Thus, toner dispenser 64 discharges toner particles when the level of the toner particles in the region of which 62 is beneath plate 60. When the level of toner particles in wedge-shaped layer 62 contacts plate 60, a charge is built up thereon producing an electrical output current which is processed through the appropriate control circuitry to de-energize the toner dispenser motor. Plate 60 is made of an electrically conducting material, preferably a metal, such as aluminum.

Figure 3:
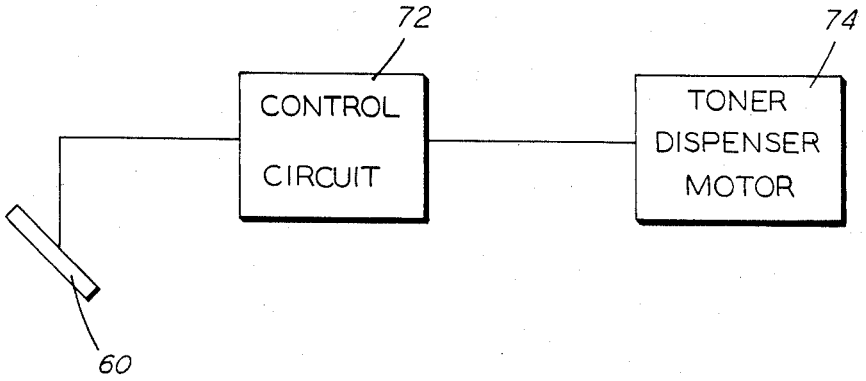
FIG. 3 is a block diagram showing the control scheme for regulating the dispensing of toner particles to the magnetic brush of the FIG. 2 development system.

Turning now to FIG. 3, there is shown plate 60 coupled to control circuit 72. When toner particles contact plate 60, plate 60 is charged generating an electrical current output. The electrical current is processed by control circuit 72 and transmitted to toner dispenser motor 74. Toner dispenser motor 74 is de-energized when plate 60 developes an electrical signal output therefrom. Alternatively, when toner particles are below the level of plate 60, plate 60 does not generate an electrical current output therefrom. Control circuit 72 now energizes toner dispenser motor 74 to rotate foam roller 70 (FIG. 2) to dispense toner particles therefrom onto roller 32 (FIG. 2). In this way, the thickness of the layer of toner particles in the region of contact with the layer of toner particles on magnetic brush roller 32 and belt 10 is controlled at a pre-selected level.

Control circuit 72 responds to either a positive or negative current from plate 60 in order to trigger the high level state, i.e. to stop dispensing of toner particles. If the current is very small, the low level state is triggered and toner particles are dispensed. Control circuit 72 is preferably a current amplifier having its input connected to plate 60 and its output connected to motor 74. Alternatively, voltage sensing rather than current sensing may be employed. In this alternate configuration, a voltage amplifier has its input connected to plate 60 with its output being connected to motor 74. A high impedance resistor is connected between the input of the voltage amplifier and a constant voltage source.

In recapitulation, the apparatus of the present invention acts as an on/off sensor to regulate the thickness of the layer of toner particles in a wedge-shaped region on the magnetic brush developer roller. A plate is charged by toner particles in contact therewith. This produces an electrical output signal from the plate which de-energizes the toner dispenser motor. Thus, toner dispensing is terminated when the toner particles contact the plate, i.e. are at a pre-selected level. When the toner particles are beneath the plate, the plate is not charged and substantially no electrical current output is produced therefrom. At this time, the control circuit energizes the toner dispenser motor to discharge toner particles from the toner hopper. In this way, the level of toner particles in the wedge-shaped region is maintained at the desired thickness. This insures satisfactory development and cleaning by the combined development and cleaning unit.

It is, therefore, evident that there has been provided in accordance with the present invention, an apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broadscope of the appended claims.

I claim:

1. An apparatus for developing a latent image recorded on an image bearing member with toner particles, including:

means for transporting toner particles closely adjacent to the latent image;

means for supplying toner particles to said transporting means; and means for sensing the thickness of the layer of toner particles formed on said transporting means, said sensing means comprising an electrically conducting plate adapted to be charged by toner particles in contact therewith and to be substantially uncharged when spaced from the toner particles, and means, in communication with said plate and said supplying means, for transmitting a signal to said supplying means de-energizing said supplying means in response to said plate being charged and energizing said supplying means in response to said plate being uncharged so as to dispense toner particles to said transporting means when toner particles are spaced from said plate.

2. An apparatus according to claim 1, wherein said plate is made from a metal material.

3. An apparatus according to claim 2, wherein said metal plate is made from aluminum.

4. An apparatus according to claim 1, wherein said transporting means includes a magnetic brush positoned adjacent the image bearing member having a layer of toner particles formed thereon.

5. An apparatus according to claim 4, wherein a wedge-shaped thickening of the layer of toner particles is formed in the region of contact of the layer of toner particles on said magnetic brush with the image bearing member.

6. An apparatus according to claim 5, wherein said sensing means detects the thickness of the wedge-shaped thickening of the layer of toner particles formed on said magnetic brush and controls said supplying means to provide toner particles to maintain the wedge-shaped thickness at a pre-selected thickness.

* * * * *